US005211087A

United States Patent [19]

Thomason

[11] Patent Number: 5,211,087

[45] Date of Patent: May 18, 1993

[54] MULTIPLE DRIVE RATCHET WRENCH

[76] Inventor: Raymon Thomason, 3415 Danbury, Amarillo, Tex. 79109

[21] Appl. No.: 962,668

[22] Filed: Oct. 19, 1992

[51] Int. Cl.[5] ..... B25B 13/46

[52] U.S. Cl. ..... 81/63.2; 81/63

[58] Field of Search ..... 81/60–63.2

[56] References Cited

U.S. PATENT DOCUMENTS

| | | | |
|---|---|---|---|
| 376,584 | 1/1888 | Cone . | |
| 1,072,980 | 9/1913 | Owen, Jr. . | |
| 1,795,150 | 3/1931 | Slazes . | |
| 2,482,387 | 9/1949 | Veneman | 81/52.4 |
| 2,542,323 | 2/1951 | Gearhart | 192/45.1 |
| 2,803,980 | 8/1957 | Vogel | 81/62 |
| 3,490,317 | 1/1970 | Rozmus | 81/62 |
| 4,631,989 | 12/1986 | Trowbridge et al. | 81/62 |
| 4,934,226 | 6/1990 | Dacey, Jr. | 81/125 |

*Primary Examiner*—James G. Smith

*Attorney, Agent, or Firm*—Dougherty, Hessin, Beavers & Gilbert

[57] ABSTRACT

A multiple drive ratchet wrench of a type where all socket drive shafts are axially in-line in a drive shaft assembly that includes bearing wheels and ratchet gear. A handle with bifurcated head then retains the bearing wheels and ratchet gear in operative alignment as a ratchet pawl mounted on the handle controls permissible rotation.

10 Claims, 2 Drawing Sheets

MULTIPLE DRIVE RATCHET WRENCH

BACKGROUND OF THE INVENTION

1. Field of the Invention

The invention relates generally to a ratchet wrench of the type receiving a selected one of multiple sockets and, more particularly, but not by way of limitation, it relates to an improved type of ratchet wrench that includes plural, different sized drive output connections.

2 Description of the Prior Art.

There have been some types of prior art ratchet wrench design that enabled plural drive shafts of different sizes. The U.S. Pat. No. 3,490,317 characterizes a type of device wherein two different sized drive shafts are driven in parallel from a counter-rotating gear connection responsive to the ratchet control. The U.S. Pat. No. 1,795,150 provides parallel drive shafts which function to provide an energizing handle connection plus oppositely rotating socket connections all in the same tool. Here again, drive shaft operation is in parallel from an interconnected gear train. A similar type of gear train operation is disclosed in U.S. Pat. No. 2,482,387.

SUMMARY OF THE INVENTION

The present invention relates to an improved type of ratchet wrench having multiple drive shafts in-line; that is, socket drive shafts of ½ inch, ⅜ inch or ¼ inch are all readily accessible. The ratchet wrench consists of a handle and bifurcated head member with drive assembly and ratcheting assembly securely maintained in position between opposite sides of the bifurcated head member. The drive assembly consists of a drive shaft having a central drive shaft formed thereon with a ½ inch square shaft on one side and the ⅜ inch shaft on the other. The central drive shaft then receives the ratchet gear thereover when positioned between bifurcated arms of the head member as a pulley or bearing wheel received over the ⅜ inch drive shaft serves to lock the drive shaft assembly within the head member. A square hole formed coaxially within the ½ inch drive shaft then provides seating for a spring-loaded ¼ inch shaft, and all three of the standard-sized socket drive shafts are readily accessible for ratcheting operation.

Therefore, it is an object of the present invention to provide a multiple drive shaft ratchet wrench where all drive shafts are in coaxial alignment.

It is also an object of the present invention to provide a multi-drive ratchet wrench that is simple of construction and reliable of operation.

It is yet further an object of the present invention to provide a multiple drive shaft ratchet wrench that is capable of exerting equally high torque on all drive shafts in either direction.

Finally, it is an object of the present invention to provide a multiple drive ratchet wrench having relatively few components and thus providing more dependable structure.

Other objects and advantages of the invention will be evident from the following detailed description when read in conjunction with the accompanying drawings which illustrate the invention.

DETAILED DESCRIPTION OF THE INVENTION

Figure 1B:
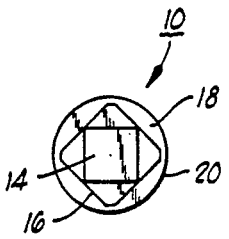
FIG. 1B is an end view of the drive shaft of FIG. 1A.
Figure 1A:
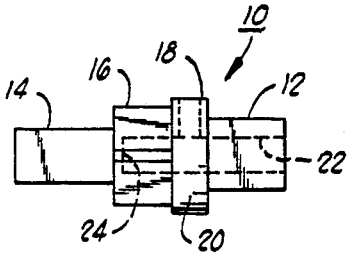
FIG. 1A is a view in side elevation of the drive shaft of the present invention.

Referring to FIG. 1A, a drive shaft 10 is unitarily formed to include a square sleeve 12 on one end which serves as the ½ inch socket drive shaft. On the other end, there is formed a square shaft 14 coaxial with shaft 12 which serves as the ⅜ inch socket drive shaft, and centrally there is formed a square shaft 16 coaxial with and 45° displaced relative to square drive shaft 14. There is also formed a circular bearing wheel 18 between square shaft 16 and square shaft 12. The circular bearing surface 20 is formed to have a ¾ inch diameter.

Figure 1C:
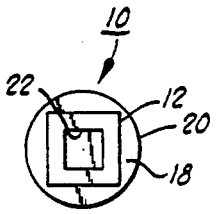
FIG. 1C is an opposite end view of the drive shaft.

FIG. 1B illustrates an end view showing bearing wheel 18 with bearing surface 20 as viewed looking past ⅜ inch shaft 14 and the ½ inch shaft 16. In similar manner, FIG. 1C shows the opposite end view of drive shaft 10 from the end having the ½ inch drive shaft 12. A coaxial, square hole 22 is formed within drive shaft 12 to a base surface 24, well within the interior of the square shaft 16. The square hole 22 serves to receive the ¼ inch socket drive shaft 26 (FIG. 2) reciprocally therein.

Figure 2:
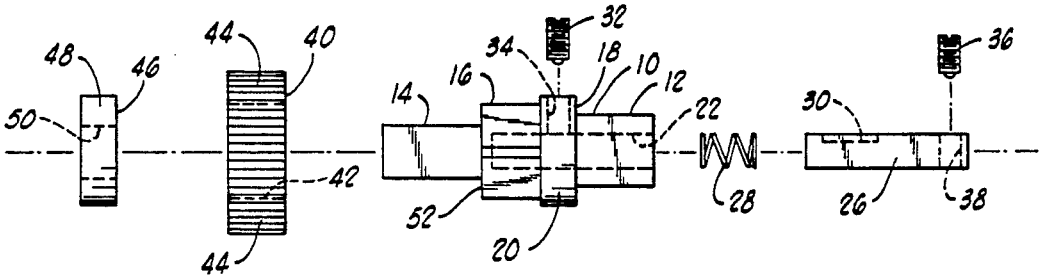
FIG. 2 is an exploded view of the drive assembly, ratchet gear and locking wheel in elevation.

Referring now to FIG. 2, the coaxial hole 22 receives a compression spring 28 therein followed by the socket drive shaft 26. The shaft 26 includes a cut-out portion 30 which coacts with plunger 32 entered into threads 34 of bearing wheel 18 to retain the segment of shaft 26 but allowing reciprocal movement. Another threaded plunger 36 is entered into threaded bore 38 of shaft 26 to provide a ball detent retainer surface. The threaded plungers 32 and 36 may be such as the Reid type NK-1-A spring plungers modified as to length.

Figure 3:
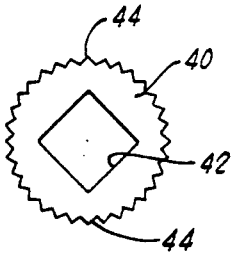
FIG. 3 is a plan view of the ratchet gear.
Figure 4:
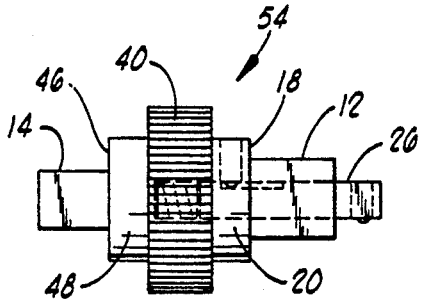
FIG. 4 is a view in elevation of the elements of FIG. 2 when assembled.

Referring also to FIG. 3, a ratchet gear 40 is formed with an axial ½ inch square hole 42 for firm reception over the ½ inch shaft 16 of drive shaft 10 (see FIG. 2). The ratchet gear 40 is formed with 36 teeth 44 therearound, the teeth 44 having a 90° included angle. Finally, a bearing wheel 46 having bearing surface 48 and ⅜ inch square hole 50 is seated firmly over ⅜ inch drive shaft 14 adjacent to square shaft wall 52 and ratchet gear 40, and the entire drive gear assembly 54 is formed as shown in FIG. 4.

Figure 5:
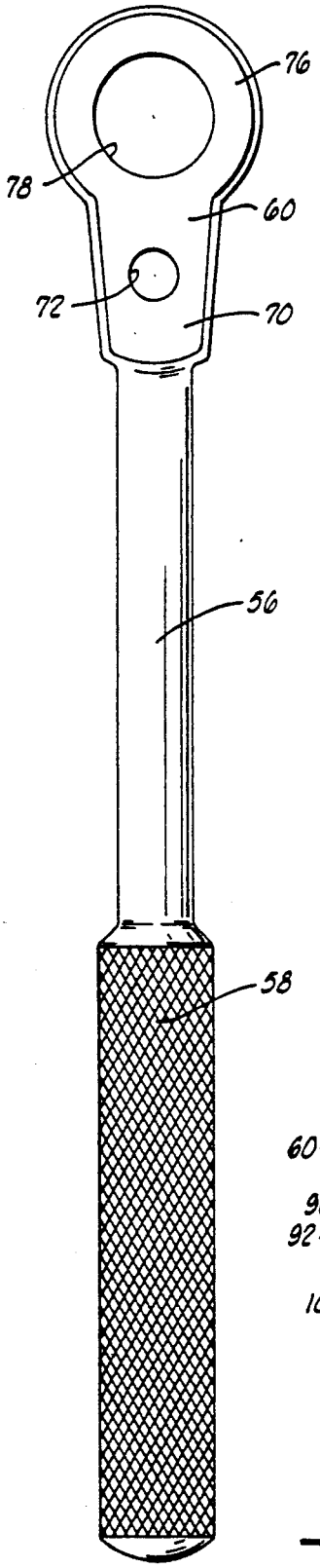
FIG. 5 is a plan view of the handle and bifurcated head of the present invention.
Figure 6:
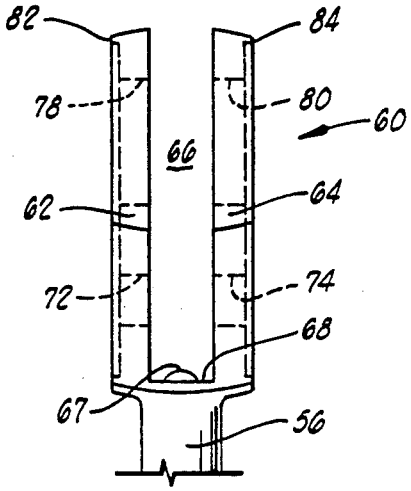
FIG. 6 is a side view in elevation of the bifurcated head member.

FIG. 5 illustrates a handle consisting of a shaft 56 and knurled gripping surface 58 and formed unitarily to extend a head 60. As shown also in FIG. 6, the head 60 is a bifurcated formation having opposite mirror-image side members 62 and 64 and defining an elongated space 66 therebetween that is very slightly wider than the thickness of ratchet gear 40. A ball type detent 67 is seated within shaft 56 at the bottom extremity 68 of space 66. The head 60 is shaped with a narrower portion 70 adjacent shaft 56, narrower portion 70 defining aligned holes 72 and 74 in respective bifurcated side members 62 and 64. Narrower portion 70 extends into a round portion 76 defining aligned, ¾ inch holes 78 and 80 in the opposite side members 62 and 64. Rims 82 and 84 are formed around the outer edges of opposite side members 62 and 64 and serve to secure a snap cover as will be further described.

Figure 8:
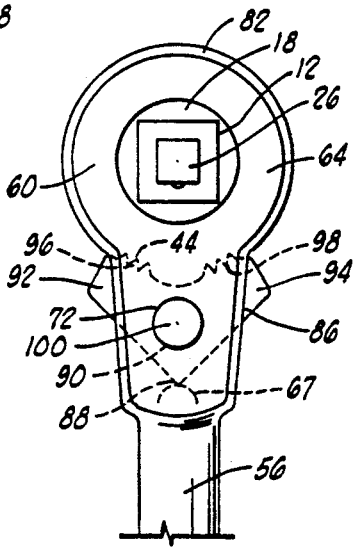
FIG. 8 is a plan view of the assembled wrench head with ratchet parts shown in phantom.
Figure 7:
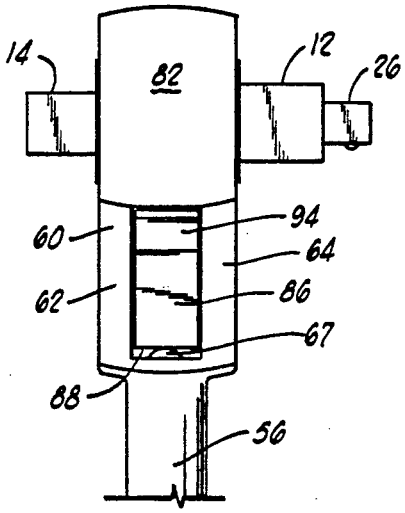
FIG. 7 is a side view in elevation of the wrench head with snap cover in place.

Referring to FIGS. 7 and 8, ratchet control is effected by a wedge shaped pawl 86 that includes a point 88, a hole 90 and opposite side tabs 92 and 94. Tabs 92 and 94 are thumb actuating surfaces which move the ratchet pawl 86 so that the point 88 is on one side or the other of ball detent 67. The opposite side gear surfaces 96 and 98, each having ratchet gear teeth similar in size and included angle to gear teeth 44 of ratchet gear 40, are moved so that one side or the other is in engagement with ratchet gear 40 to prevent rotation around and against the ratchet teeth. That is, when tab 94 is pushed in and gear teeth 98 are engaged, the drive shafts 12 and 26 are free to move counterclockwise relative to head 60. And, when tab 92 is pressed to engage pawl teeth 96 with ratchet gear teeth 44, the drive shafts 12 and 26 can freely move clockwise relative to head member 60. A snap cover of arcuate shape may be snapped in place seizing on rims 82 and 84 to provide end cover of the wrench head assembly.

In assembly, the ratchet pawl 86 is rotatably maintained by means of a pin 100 that is force-fit through pawl hole 90 while opposite ends are rotatively retained within head member holes 72 and 74. The drive shaft assembly 54 is positioned in drive head 60 by insertion of ratchet gear 40 down within elongated space 66 and subsequent insertion of drive shaft 10 through hole 80 to seat the ½ inch square drive surface 16 in force-fit within the square hole 42 of ratchet gear 40. Thereafter, the bearing wheel 48 is positioned with square hole 50 force fit over drive shaft 14 thus securing the entire assembly. While the ratchet pawl 86 is shown with point 88 in a central position directly over the ball detent 67, it should be understood that it will always be operating on either one side or the other of ball detent 67.

The foregoing discloses a novel structure that enables in-line rotative actuation of a multiple of standardized drive shafts, i.e. ¼ inch, ⅜ inch and ½ inch drives. The device utilizes relatively few moving parts while still affording in-line multiple size socket drives that are rugged and dependable. The singular and readily controllable ratchet drive of the present invention provides rotational output control to all socket drive shafts simultaneously so that the socket drives can be selectively utilized as wrench and/or socket requirements dictate.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A ratchet wrench having multiple-size socket drive shafts, comprising:

a rotational drive shaft formed to extend a smaller and a larger square drive shaft coaxially from respective first and second ends, and having a first bearing wheel and an interior square drive shaft formed therebetween, said larger drive shaft having an axially aligned square hole formed therein;

a third drive shaft of square cross-section and elongated having inner and outer ends that is slidingly received and maintained within said axially aligned square hole against spring pressure;

a ratchet gear having a central square hole that is retained on said interior square drive shaft adjacent said first bearing wheel;

a second bearing wheel with central square hole retained on said smaller square drive shaft adjacent said ratchet gear;

a bifurcated head member having a bifurcation space and a handle extending therefrom, said head member supporting said first and second bearing wheels rotatively with the ratchet gear disposed in the bifurcation space; and a ratchet pawl movably retained within said bifurcation space that is manipulable to contact said ratchet gear and control permissible rotation of the drive shaft relative to the handle.

2. A ratchet wrench as set forth in claim 1 wherein said bifurcated head member comprises:

a yoke and first and second side members, said side members each having a first hole formed therethrough for receiving said first and second bearing wheels therein, and each having a second hole spaced from said first hole for retaining a pivot pin that is secured to support said ratchet pawl adjacent the ratchet gear.

3. A ratchet wrench as set forth in claim 1 wherein the rotational drive shaft is further characterized in that:

said smaller drive shaft is adjacent and oriented at a forty-five degree angle relative to said interior square drive shaft.

4. A ratchet wrench as set forth in claim 1 wherein said third drive shaft further comprises:

a threaded bore formed transversely proximate the outer end of the shaft; and a spring plunger secured in said threaded bore to provide a detent surface.

5. A ratchet wrench as set forth in claim 4 wherein said bifurcated head member comprises:

a yoke and first and second side members, said side members each having a first hole formed therethrough for receiving said first and second bearing wheels therein, and each having a second hole spaced from said first hole for retaining a pivot pin that is secured to support said ratchet pawl adjacent the ratchet gear.

6. A ratchet wrench having multiple socket drive shafts, comprising:

an elongated drive shaft formed unitarily with a generally central first bearing wheel that extends axially into a first large square socket shaft having a square hole formed axially therein, and extending axially from the other side of the bearing wheel into a large square shaft displaced 45° from said first large square socket shaft and terminating in a mid-size square socket shaft that is displaced 45° from said large square shaft;

a small square socket shaft reciprocally disposed within said square hole in the large square socket shaft;

a ratchet gear having radius larger than said central bearing wheel received securely over said large square shaft;

a second bearing wheel having a central square hole and a radius the same as said central bearing wheel received securely over said mid-size square shaft adjacent to said large square shaft and said ratchet gear;

wrench head means having a handle and receiving the elongate drive shaft transversely therethrough with said first and second bearing wheels rotatively seated therein; and ratchet pawl means seated on said wrench head means and actuatable to control direction of permissible rotation of said socket drive shaft.

7. A ratchet wrench as set forth in claim 6 wherein:

said large square shafts are ½ inch, said mid-size square shaft is ⅜ inch and said small square shaft is ¼ inch.

8. A ratchet wrench as set forth in claim, 6 wherein said wrench head further comprises:

first and second bifurcated side members aligned in parallel and each having an upper hole for receiving respective first and second bearing wheels rotatively seated therein while said ratchet gear is disposed for rotation between said side members.

9. A ratchet wrench as set forth in claim 8 wherein said ratchet pawl means further comprises:

first and second lower holes formed in alignment in respective first and second bifurcated side members;

a pivot pin disposed between said first and second lower holes; and a ratchet pawl rotatively held by said pivot pin in actuating alignment with said ratchet gear.

10. A ratchet wrench as set forth in claim 6 wherein said small square shaft comprises:

a compression spring inserted within said square hole to bias said small square shaft outward; and means for limiting the amount of outward travel of said small square shaft.

* * * * *